US005443392A

United States Patent [19]

Longueville et al.

[11] Patent Number: 5,443,392

[45] Date of Patent: Aug. 22, 1995

[54] SHIELDING DEVICE FOR RECTANGULAR CABLE PLUGS

[75] Inventors: Jacques Longueville, Oostkamp; Albert Hoolhorst, Aardenburg, both of Belgium

[73] Assignee: Siemens Aktiengesellschaft, Munich, Germany

[21] Appl. No.: 145,462

[22] Filed: Oct. 29, 1993

[30] Foreign Application Priority Data

Mar. 31, 1993 [DE] Germany ..... 93 04 929.3

[51] Int. Cl.[6] ..... H01R 13/648

[52] U.S. Cl. ..... 439/108; 439/607

[58] Field of Search ..... 439/95, 108, 607, 609

[56] References Cited

U.S. PATENT DOCUMENTS 5,067,914 11/1991 Seidel et al. ..... 439/609

FOREIGN PATENT DOCUMENTS 9205780 7/1992 Germany .

*Primary Examiner*—Eugene F. Desmond

*Attorney, Agent, or Firm*—Herbert L. Lerner; Laurence A. Greenberg

[57] ABSTRACT

A shielded transfer system is disposed on a back panel printed wiring board and has a strip body with partitions subdividing the strip body into individual rectangular chambers of equal size for receiving cable plugs having a shielding housing with a rectangular cross section. A shielding device for the cable plugs includes additional function elements disposed in the strip body for performing assigned functions, in particular for guiding, contacting, encoding and locking the cable plugs. The additional function elements are constructed and disposed for permitting the rectangular cable plugs with a plug cross section of a certain unit size and smaller rectangular cable plugs with a plug cross section being one-half and one-fourth of the plug cross section of the unit size, to be selectively inserted into the chambers of the strip body, while preserving and utilizing all of the functions of the additional function elements.

14 Claims, 3 Drawing Sheets

SHIELDING DEVICE FOR RECTANGULAR CABLE PLUGS

BACKGROUND OF THE INVENTION

Field of the Invention

The invention relates to a shielding device for cable plugs constructed with a shielding housing of rectangular cross section, in a shielded transfer system disposed on a back panel printed wiring board, having a strip body subdivided by partitions into individual rectangular chambers of equal size for insertion of the cable plugs, and having additional function elements disposed in the strip body, in particular for guiding, contacting, encoding and locking the cable plugs.

In shielded transfer systems disposed in the region of a back panel printed wiring board, shielded transfer bridges that include a contact strip are used for the signal transfer in order to receive cable plugs that are insertable next to one another and produce a disconnectable line connection.

German Petty Patent G 92 05 780.2 discloses a contact strip for a shielded transfer system that includes a plastic strip body which is provided with separate shrouds on its long sides and is subdivided by partitions into individual rectangular chambers of equal size. Each chamber is constructed with guide and contacting devices, as well as two guide prongs which face one another and are disposed on the long sides of the strip body, for securing the cable plugs with respect to a 180° rotation. Cable plugs that are of equal size and have a housing of rectangular cross section, are inserted next to one another into the known contact strip. In the case of smaller plugs, the contact strip is neither provided nor suitable. In such devices the need now exists to make it possible to connect not only cable plugs of a certain unit size, but also smaller plugs.

SUMMARY OF THE INVENTION

It is accordingly an object of the invention to provide a shielding device for rectangular cable plugs, which overcomes the hereinafore-mentioned disadvantages of the heretofore-known devices of this general type and which enables the use of smaller plugs as well, without changing the structure of the shielding device.

With the foregoing and other objects in view there is provided, in accordance with the invention, in a shielded transfer system being disposed on a back panel printed wiring board and having a strip body with partitions subdividing the strip body into individual rectangular chambers of equal size for receiving cable plugs having a shielding housing with a rectangular cross section, a shielding device for the cable plugs, comprising additional function elements disposed in the strip body for performing assigned functions, in particular for guiding, contacting, encoding and locking the cable plugs, the additional function elements having a construction and disposition permitting the rectangular cable plugs with a plug cross section of a certain unit size (1 SU=one system unit) and smaller rectangular cable plugs with a plug cross section being a certain fraction, namely one-half ($\frac{1}{2}$ SU) and one-fourth ($\frac{1}{4}$ SU) of the plug cross section of the unit size (1 SU), to be selectively inserted into the chambers of the strip body, while preserving and utilizing all of the functions of the additional function elements.

As a result, a shielding device according to the invention is constructed in a manner that is compatible in terms of plugging and function, both for cable plugs of a certain unit size, for instance 1 SU (SU=system unit) and for smaller plugs having a plug cross section which is $\frac{1}{2}$ SU or $\frac{1}{4}$ SU. In other words, a 1-SU chamber of the strip body is constructed in such a way that all of the plugging and functional requirements are preserved if corresponding smaller plugs are inserted. In a shielding device according to the invention, this is assured without having to modify the structure of the shielding device for that purpose. In other words, the additional function elements of the shielding device are from the very outset disposed and constructed in such a way that while preserving and utilizing all of the functions they perform, cable plugs having a size of 1/1, $\frac{1}{2}$ and $\frac{1}{4}$ can be selectively selected.

In accordance with another feature of the invention, it is appropriate from an electrical and mechanical standpoint if the chambers of the strip body that are intended for smaller cable plugs are subdivided by a further partition into two equal-sized chamber compartments. However, such partitions are not necessary for the plugging and functional compatability of the shielding device.

In accordance with a further feature of the invention, the functions of the additional function elements are largely achieved with a rectangular base plate of insulating material, for contact prongs, which is disposed in each chamber; the base plate is constructed on two opposed long sides with side walls being spaced apart from the long sides of the strip body; and the side walls are divided in two in the middle of their length. Such a component may include a simple plastic injection molded part, with the side walls serving the purpose of guiding, polarizing and encoding the cable plugs.

In accordance with an added feature of the invention, the side walls of the base plate have a smooth surface on the side toward the long sides of the strip body, and on the opposed inner surfaces are formed by ribs and grooves, extending in the plugging direction, having an asymmetrical contour, for polarizing and encoding the cable plugs.

In accordance with again another feature of the invention, the strip body has long sides facing each other and locking elements on the long sides for the cable plugs, each two of the locking elements being disposed in a respective one of the chambers of the strip body, and the locking elements being disposed symmetrically or asymmetrically with relative to one of the at least one further partition dividing the chambers into two equal-size chamber compartments.

In accordance with an additional feature of the invention, the strip body includes a rectangular sheet-metal frame with longitudinal plates which are joined at the ends and at equal intervals to one another by crosswise plates.

In accordance with yet another feature of the invention, the longitudinal plates of the strip body are additionally joined together in the chambers provided for the smaller cable plugs by an intermediate crosswise plate disposed in a plane of symmetry of the chamber.

In accordance with yet a further feature of the invention, each chamber or chamber compartment is constructed with resilient grounding contacts, so that even with smaller cable plugs good grounding contact is attained. Cable plugs that are $\frac{1}{2}$ SU in size are contacted on all sides and cable plugs that are $\frac{1}{4}$ SU in size are contacted on three sides, while on the fourth side they are pressed against the adjacent cable plug.

In accordance with yet an added feature of the invention, all of the longitudinal and crosswise plates of the sheet-metal frame have driving prongs being inserted into and secured in through-contacted bores formed in the printed wiring board, the bores communicating with grounding layers of the printed wiring board.

In accordance with yet an additional feature of the invention, the crosswise plates have hooks, and the longitudinal plates of the sheet-metal frame, as viewed in an upper region in a longitudinal direction, have free cuts formed therein alternating with inward-pointing spring arms extending in a plugging direction as locking elements, and webs being angled inward and having slits formed therein for the hooks.

In accordance with a concomitant feature of the invention, the webs of each of the longitudinal plates are formed of two half-webs for the crosswise plates, one complete middle web for the intermediate crosswise plate and two of the spring arms, for each respective one of the chambers.

Other features which are considered as characteristic for the invention are set forth in the appended claims.

Although the invention is illustrated and described herein as embodied in a shielding device for rectangular cable plugs, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
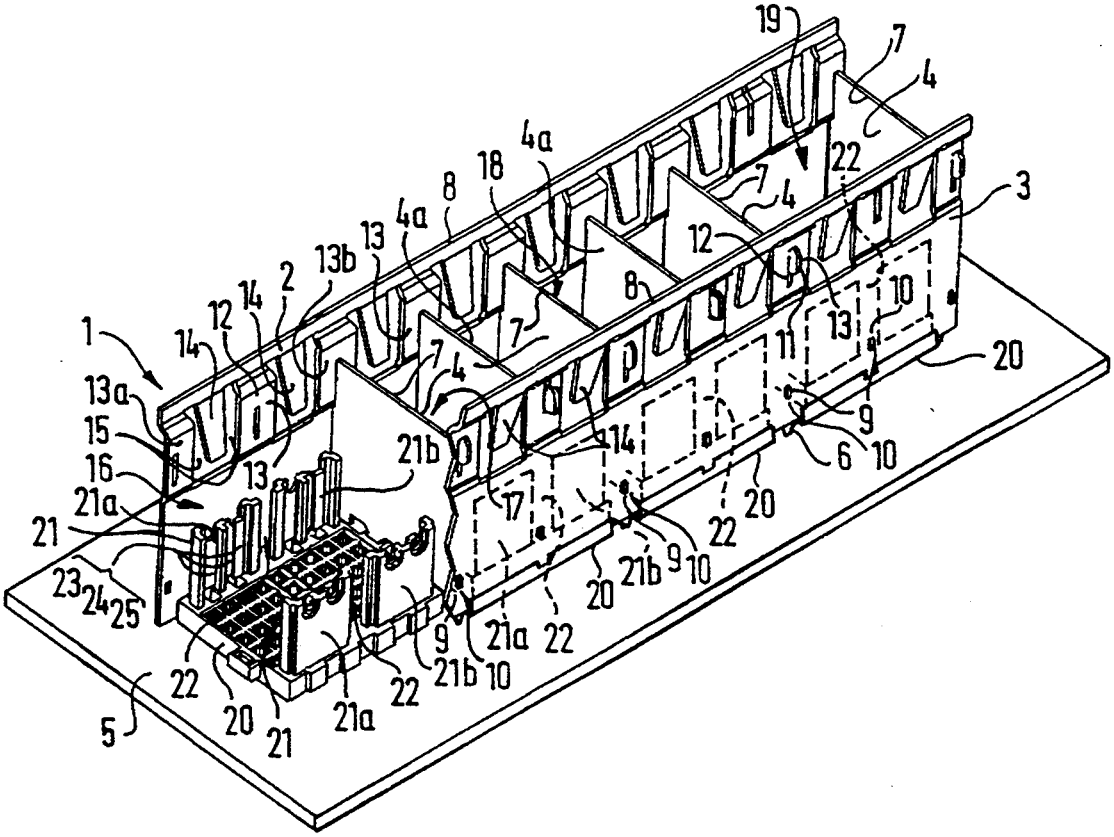
FIG. 1 is a diagrammatic, perspective view showing the structure of a shielding device secured to a back panel printed wiring board.
Figure 2:
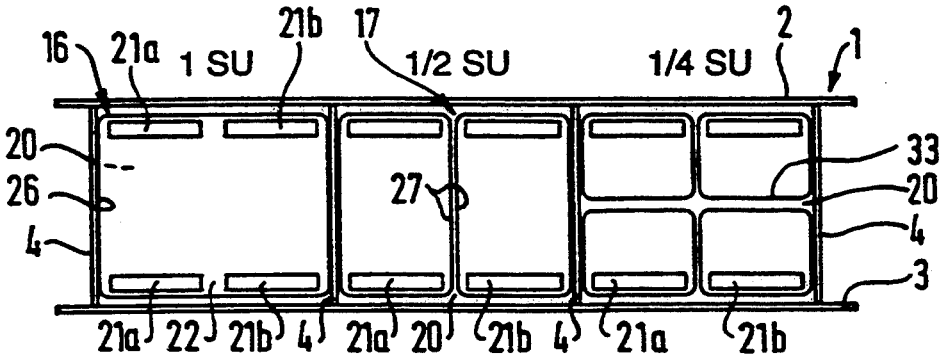
FIGS. 2–6 are each plan views of a portion of a shielding device with different additional functions.
Figure 5:
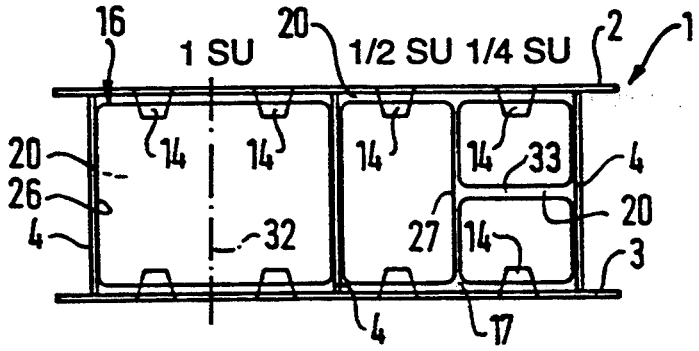
Figure 6:
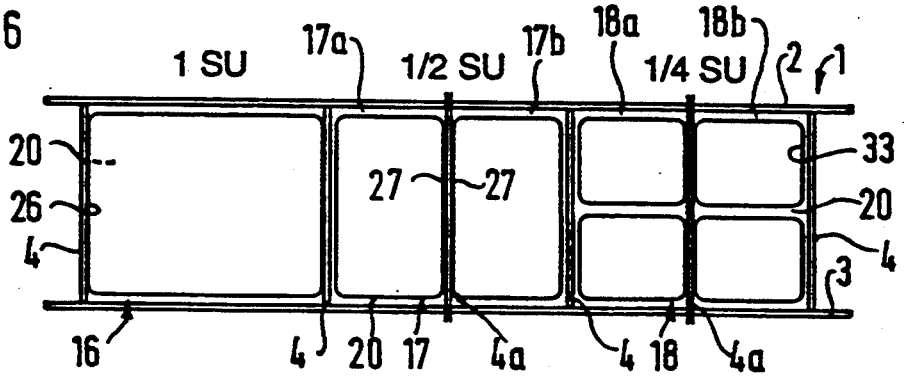

Referring now to the figures of the drawing in detail and first, particularly, to FIG. 1 thereof, there is seen a shielding device that has a strip body 1, which in this case includes a rectangular sheet-metal frame. This frame is formed by two longitudinal plates or partitions 2 and 3 that are parallel to one another and by a plurality of mutually parallel crosswise plates or partitions 4 that join the longitudinal plates together crosswise. The crosswise plates 4 are disposed at ends of the longitudinal plates and at certain equal intervals determined by cable plugs, and thus form first, second, third and fourth rectangular chambers 16, 17, 18 and 19 of equal size for cable plugs that have a shield housing of rectangular cross section and a certain unit size of 1 SU (SU=system unit, wherein 1 SU=25 mm). Accordingly, the crosswise plates 4 are disposed at intervals of 1 SU. Selectively, instead of a 1 SU cable plug, the chambers 16–19 may also receive smaller rectangular cable plugs having a plug cross section which is a certain fraction of that of the 1 SU unit size. For instance a chamber, such as the second chamber 17, may receive two smaller cable plugs that are ½ SU in size, for instance next to one another, having a plug cross section which is ½ the plug cross section of the unit size 1 SU. Four smaller rectangular cable plugs, for instance, each being ¼ SU in size and having a plug cross section which is ¼ the plug cross section of the unit size 1 SU, may be received in a further chamber, such as the third chamber 18. Such possibilities are shown in FIGS. 2, 3, 4 and 6 for a strip body which receives not only a cable plug that is 1 SU in size but also two cable plugs that are ½ SU in size and four cable plugs that are ¼ in size. However, as is shown in FIG. 5, it is also possible for a mixed assembly with one cable plug that is ½ SU in size and two cable plugs that are ¼ SU in size to be provided in the same chamber, for instance the second chamber 17. Therefore, those chambers that are intended for smaller cable plugs which are ½ SU and ¼ SU in size, for instance the chambers 17 and 18, are subdivided, as FIGS. 1 and 6 show, into two equal-size chamber compartments 17*a* and 17*b* on one hand, and 18*a* and 18*b* on the other hand, by means of an intermediate crosswise plate or partition 4*a* disposed in a plane of symmetry of the applicable chamber. These intermediate crosswise plates 4*a* form an additional crosswise connection of the two longitudinal plates 2 and 3.

In order to lend the sheet-metal frame maximum stability, the longitudinal plates 2 and 3 are joined in a certain way to the crosswise plates 4 and 4*a*, which extend with an upper edge 7 to near an upper edge 8 of the longitudinal plates. In other words, in each case at opposed points, the crosswise plates are interlocked in hooklike fashion with the longitudinal plates 2, 3, as close as possible to the upper edge 8 of these plates. The interlocking takes place approximately in the upper quarter of the height of the longitudinal plates, and as close as possible to the lower edge of the longitudinal plates, in other words approximately in the lower quarter of the height of the longitudinal plates. The crosswise plates 4 and 4*a* have lateral protrusions 9, constructed as cams or toes, which are each inserted into a hole 10 in the applicable longitudinal plate. Moreover, the crosswise plates 4 are constructed with lateral hooks 11, which are bent toward the upper edge 8 of the longitudinal plates 2, 3. These hooks 11 engage slits 12 in the longitudinal plates that extend perpendicularly to a printed wiring board 5. The slits 12 in this case are disposed in webs 13 that are bent at an angle inward. The webs are provided in the upper region of the longitudinal plates, as seen in the longitudinal direction, by means of free cuts 15 alternating with inward-pointing spring arms 14 extending in the plugging direction. In a chamber, for instance in the chamber 16, which is formed by two adjacent crosswise plates 4 that are spaced apart by 1 SU, each longitudinal plate thus has one complete middle web 13 and two half webs 13*a* and 13*b* in it, which produce a tight, play-free guidance for the insertable cable plug. In the inserted state, the cable plug can then be interlocked by two of the spring arms 14 per longitudinal plate, because protrusions in metal shielding housings 26, 27, 33 of the cable plugs lock into place behind these spring arms. The metal shielding housings 26, 27, 33 are described in greater detail below.

The longitudinal plates 2, 3 and the crosswise plates 4, 4*a* serving as shielding plates for cable plugs that are insertable next to one another, are each constructed with a number of driving prongs 6 on their lower edge that are oriented toward the printed wiring board 5. Therefore, the sheet-metal frame 1 is inserted as a whole into through-contacted bores of the printed wiring board 5 that communicate with grounding layers of the printed wiring board. Thus a close shielding contact is produced between the longitudinal and crosswise plates and these grounding layers, and strong anchoring of the shielding device to the printed wiring board is assured. The above-described structure of a shielding device, in its state in which it is secured to the printed wiring board 5, results in an intrinsically stable centering strip for a plurality of cable plugs of different sizes that can be inserted next to one another. One such centering strip, in the assembled state, or in other words in the state in which it has been assembled with prong fields and contact prongs, then forms a contact strip. In the unassembled state, along with a separate contact strip, it forms a transfer bridge for a shielded transfer system disposed on a back panel printed wiring board.

In this kind of shielding device, additional functional elements are also provided in the strip body, in particular for guidance, contacting, encoding and locking of the cable plugs. In order to enable selective use of the chambers of the centering strip for rectangular 1 SU, ½ SU and ¼ SU cable plugs while preserving and utilizing all of the functions of the additional functional elements, these elements are constructed and disposed in an appropriate way with a view to all of the functions assigned to them.

In the shielding device of the invention, a substantial portion of these additional functions is assigned to a rectangular base plate 20 of insulating material, for contact prongs, which is provided in each chamber 16, 17, 18 and 19. This base plate takes on the additional functions of guidance and centering as well as polarizing and encoding of all of the cable plugs in the same way. In other words, from the outside, the base plate is constructed in such a way that it can perform these functions not only for cable plugs that are 1 SU in size but also for smaller cable plugs that are ½ SU and ¼ SU in size. To that end, the base plate 20, which is laterally protruding from the lower edge of the longitudinal plates 2, 3 and is pressed against the printed wiring board 5 by the driven-in longitudinal plates, is constructed on two opposed sides with vertical side walls 21 that are spaced apart from the longitudinal plates 2, 3 of the strip body 1. These side walls are divided in two by a cutout 22 which is disposed in the middle and extends in the plugging direction, so that two wall parts 21*a* and 21*b* are each formed laterally of the cutout that is in alignment with the slit 12 and the middle web 13. The cutout 22 is wide enough to ensure that there is space between the wall parts 21*a* and 21*b* for both an intermediate crosswise plate 4*a* located in a plane of symmetry of a chamber and the encompassing metal shielding housing 26, 27, 33 of a cable plug. The side walls 21 or their wall parts 21*a* and 21*b*, have a smooth surface on the outer sides thereof facing toward the longitudinal sides 2, 3. As is seen in FIGS. 1 and 4, on the inner sides or surfaces facing each other, the wall parts 21*a* and 21*b* are constructed as ribs 23, 24 and grooves 25 of an asymmetrical contour that extends in the plugging direction. The side walls 21 cooperate with corresponding side parts disposed inside the shielding housing of a cable plug and thus take on the functions of polarizing and encoding a cable plug. The ribs 23 seen in FIG. 4 may, for instance, be ribs made by being broken out.

The additional functional elements and the individual functions assigned to them will be described briefly below in conjunction with FIGS. 2–6.

The side walls 21, that are divided in two, of the base plate 20 that is disposed in the same version in each chamber, make it possible to insert both a 1-SU cable plug and the smaller ½-SU and ¼-SU cable plugs. As FIG. 2 clearly shows, because of the central division of a base plate in two, a 1-SU cable plug can be inserted, for instance into the chamber 16, in such a way that the encompassing metal shielding housing 26 of the plug then encloses all four wall parts 21*a* and 21*b*. The division in two also makes it possible to insert two ½-SU cable plugs, for instance into the chamber 17. The cutout 22 between the wall parts 21*a* and 21*b* admits the two encompassing metal shielding housings 27 of the ½-SU cable plugs, each of which encloses two wall parts 21*a* or 21*b*. Then, because of the division of the side walls 21 in two in the middle, a total of four plugs that are ¼ SU in size can be inserted into the chamber 18, with their shielding housings 33 each enclosing one wall part 21*a* or 21*b*.

When all of the cable plugs are inserted, the side walls 21 of the base plates perform a guiding and centering function, with the ½-SU cable plugs being centered in the chamber 17 by the two wall parts 21*a* and optionally by an intermediate crosswise plate 4*a*, and the ¼-SU cable plugs in the chamber 18 each being centered by a respective wall part 21*a* or 21*b* and a crosswise plate 4 and optionally by an intermediate crosswise plate 4*a*.

Figure 3:
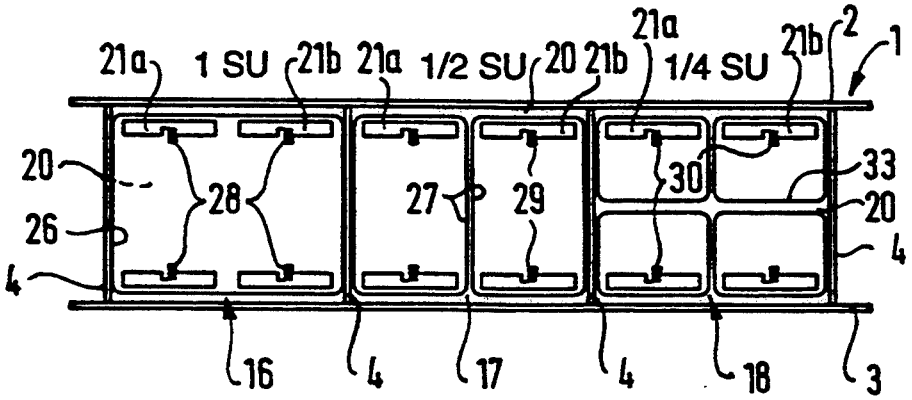
Figure 4:
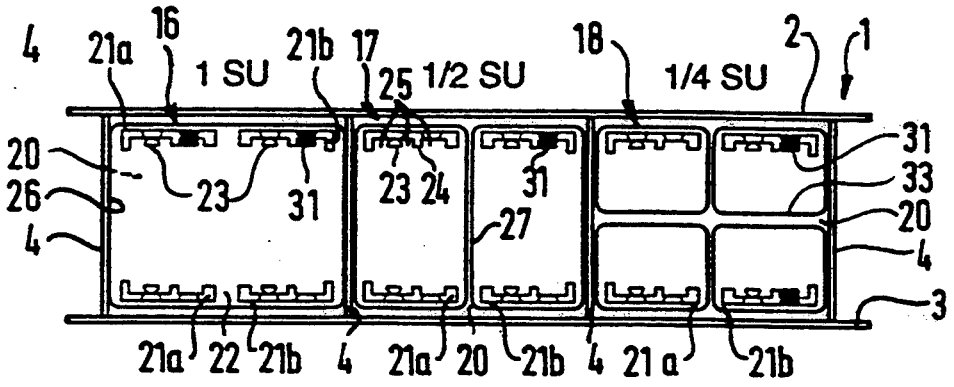

The polarizing of the cable plugs, that is securing these plugs with respect to a 180° rotation, can be seen in FIG. 3, in which, as in FIG. 4, corresponding functional elements of the corresponding side portions of a cable plug are shown in black. As already mentioned, the side walls 21 or their wall parts 21*a* and 21*b* of the base plates 20 are provided with an asymmetrical contour, which is formed by the ribs 23, 24 and grooves 25 extending in the plugging direction. If the cable plugs of different sizes are to be introduced after being rotated by 180°, into the various chambers 16, 17 and 18, then in the case of the 1-SU cable plug in the chamber 16, four counterpart elements 28 block the side portions of the cable plug. In the case of the ½-SU cable plug in the chamber 17, two counterpart elements 29 perform such blocking, and for the ¼-SU cable plug in the chamber 18, one counterpart element 30 performs this blocking. Therefore, a secure, reliable polarization of the cable plugs of the 1 SU, ½ SU and ¼ SU sizes is assured in a simple way in any arbitrary chamber.

The function of the encoding system is also integrated in a plugging and functionally compatible manner into the side walls 21 of the base plate 20, for all three cable plug sizes, as seen in FIG. 4. To that end, the wall parts 21*a*, 21*b* are provided with the formed-on encoding ribs 23, and the cable plugs or their corresponding side portions are provided with assemblable encoding elements 31. In this way, the chamber 16, for instance, can receive eight encoding keys in four groups for the 1-SU cable plug. Through the use of a suitable construction, 64 combinations can then be set for a 1-SU cable plug, while six combinations can still be set for ½-SU cable plugs in the chamber 17, and four combinations can still be set for ¼-SU cable plugs in the chamber 18.

The locking function for the cable plugs inserted into the chambers is performed by the spring arms 14 that are shown in FIG. 1. As in FIG. 5, for example, these arms are disposed symmetrically with respect to a line of symmetry 32 that is shown in dot-dash lines and divides the chamber 16 into two imaginary chamber components of equal size, or with respect to an intermediate crosswise plate 4*a* that subdivides the chamber 17 in FIG. 6 into the two chamber compartments 17*a* and 17*b* of equal size. However, the locking elements formed by the spring arms 14 may also be located asymmetrically. As FIG. 5 shows, they perform their function in each chamber, regardless of the size of the cable plug being introduced. Therefore a 1-SU cable plug in the chamber 16 is locked by a total of four spring arms 14, or in other words two spring arms on each long side, while in the chamber 17, in which one ½-SU and two ¼-SU cable plugs are disposed, the ½-SU cable plug is locked by a total of two spring arms 14, and the two ¼-SU cable plugs are each locked by one further spring arm 14.

The function of lateral retention of the cable plugs, in a shielding device according to the invention, is assigned to the special sheet-metal construction of the centering strip, as already described. The cable plugs are intended to be able to withstand major crosswise strains where the cable emerges. For that reason, the longitudinal and crosswise plates 2, 3 and 4, respectively, are joined stably together near the upper edge of the longitudinal plates. Particularly for the smaller ½-SU and ¼-SU cable plugs, one additional intermediate crosswise plate 4*a* per chamber may be provided, as shown in FIGS. 1 and 6, and centered in the plane of symmetry 32, and can be joined to the longitudinal plates on one hand and to the printed wiring board on the other hand in the same manner as the crosswise plates 4, in order to intercept the shear forces.

In order to provide electromagnetic shielding, each chamber 16, 17, 18 or 19, or each chamber compartment 17*a*, 17*b*; 18*a*, 18*b*, is provided with non-illustrated encompassing, resilient grounding contacts which assure a low-impedance grounding contact between the printed wiring board and the metal shielding housing 26, 27, 33 of the cable plugs. The additional intermediate crosswise plates 4*a* in FIGS. 1 and 6 for the ½-SU and ¼-SU cable plugs likewise have resilient grounding contacts on both sides and, as mentioned, are driven into the printed wiring board 5. As a result, ½-SU cable plugs are likewise contacted on all four sides. The ¼-SU cable plugs are contacted on three sides in the centering strip. The fourth side is pressed against the neighboring plug by the grounding contact forces and thus closes the grounding circuit.

We claim:

1. In a shielded transfer system being disposed on a back panel printed wiring board and having a strip body with partitions subdividing said strip body into individual rectangular chambers of equal size for receiving cable plugs having a shielding housing with a rectangular cross section, a shielding device for the cable plugs, comprising additional function elements disposed in said strip body for guiding, contacting, encoding and locking the cable plugs, said additional function elements being disposed and having means for permitting the rectangular cable plugs with either a plug cross section of a certain unit size or smaller rectangular cable plugs with a plug cross section being one-half and one-fourth of the plug cross section of the unit size, to be selectively inserted into said chambers of said strip body, and said additional function elements being disposed such that all of the functions of said additional function elements are preserved and utilized regardless of whether the cable plugs of the unit size or the smaller cable plugs are inserted.

2. The shielding device according to claim 1, wherein said additional function elements include at least one further partition subdividing at least one of said chambers of said strip body intended for receiving the smaller cable plugs into two equal-sized chamber compartments.

3. The shielding device according to claim 1, wherein said additional function elements include rectangular base plates of insulating material each being disposed in a respective one of said chambers, for contact prongs; said strip body having long sides; said base plates each having two opposed long sides with side walls spaced apart from said long sides of said strip body; and said side walls being divided in two in the middle of the length thereof.

4. The shielding device according to claim 3, wherein said side walls of said base plate have a cutout formed therein in the middle dividing said side walls in two.

5. The shielding device according to claim 3, wherein said side walls of said base plates have smooth surfaces each facing toward one of said long sides of said strip body, and said side walls of said base plate have opposed inner surfaces formed of ribs and grooves extending in a plugging direction and having an asymmetrical contour, for polarizing and encoding the cable plugs.

6. The shielding device according to claim 2, wherein said strip body has long sides facing each other and locking elements on said long sides for the cable plugs, each two of said locking elements being disposed in a respective one of said chambers of said strip body, and said locking elements being disposed symmetrically or asymmetrically with relative to one of said at least one further partition dividing said chambers into two equal-size chamber compartments.

7. The shielding device according to claim 1, wherein said strip body includes a rectangular sheet-metal frame with longitudinal plates having ends, and crosswise plates joining said longitudinal plates to one another at said ends and at equal intervals.

8. The shielding device according to claim 7, including intermediate crosswise plates each being disposed in a plane of symmetry in a respective one of said chambers provided for the smaller cable plugs, said longitudinal plates of said strip body being additionally joined together by said intermediate crosswise plates.

9. The shielding device according to claim 2, wherein each of said chambers has resilient grounding contacts.

10. The shielding device according to claim 2, wherein each of said chamber compartments has resilient grounding contacts.

11. The shielding device according to claim 7, wherein all of said longitudinal and crosswise plates of said sheet-metal frame have driving prongs being inserted into and secured in through-contacted bores formed in the printed wiring board, said bores communicating with grounding layers of the printed wiring board.

12. The shielding device according to claim 7, wherein said crosswise plates have hooks, and said longitudinal plates of said sheet-metal frame, as viewed in an upper region in a longitudinal direction, have free cuts formed therein alternating with inward-pointing spring arms extending in a plugging direction as locking elements, and webs being angled inward and having slits formed therein for said hooks.

13. The shielding device according to claim 12, including intermediate crosswise plates each being disposed in a plane of symmetry in a respective one of said chambers provided for the smaller cable plugs, said longitudinal plates of said strip body being additionally joined together by said intermediate crosswise plates, said webs of each of said longitudinal plates being formed of two half-webs for said crosswise plates, one complete middle web for said intermediate crosswise plate and two of said spring arms, for each respective one of said chambers.

14. The shielding device according to claim 1, wherein said additional function elements are further disposed for centering, securing and polarizing the cable plugs.

* * * * *